United States Patent [19]

Lewis

[11] Patent Number: 4,673,234

[45] Date of Patent: Jun. 16, 1987

[54] CONNECTOR/ADAPTER ASSEMBLY FOR FLEXIBLE CONDUIT OR ELECTRICAL CABLE

[75] Inventor: Milton R. Lewis, Fremont, Calif.

[73] Assignee: Icore International, Inc., Sunnyvale, Calif.

[21] Appl. No.: 734,637

[22] Filed: May 15, 1985

[51] Int. Cl.[4] ..... H01R 13/58

[52] U.S. Cl. ..... 439/469; 439/323

[58] Field of Search ..... 339/103 R, 103 M, 89 R, 339/89 M, 90 R, 184 R, 184 M, 186 R, 186 M

[56] References Cited

U.S. PATENT DOCUMENTS

| | | | |
|---|---|---|---|
| 2,563,712 | 8/1951 | Frei et al. | 339/89 M |
| 2,700,140 | 1/1955 | Phillips | 339/89 M |
| 2,740,098 | 3/1956 | Phillips | 339/89 R |
| 3,078,436 | 2/1963 | Berry | 339/89 M |
| 3,646,496 | 2/1972 | Williams | 339/89 M |

*Primary Examiner*—John McQuade

*Attorney, Agent, or Firm*—Townsend and Townsend

[57] ABSTRACT

An assembly for use in coupling a flexible conduit or electrical cable to an electrical connector when the assembly and the connector must be clocked due to the fact that the conduit or cable cannot be twisted or rotated about its central axis. The assembly includes an adapter body adapted to be coupled to the conduit or cable and a nut rotatably mounted on an adjacent end of the body, the nut having threads for coupling the body to a connector to complete the assembly. The connector is adapted to be coupled to a panel-mounted connector or to a connector coupled to a second conduit or electrical cable. The body has a clocking ring rotatably mounted within one end of the body, the ring being held against axial removal from the body and being rotatable through a limited arc. The two connectors can readily mate with each other by merely rotating the clocking ring until proper clocking alignment is assured. The clocking ring thereby permits a predetermined rotational tolerance while avoiding the need to rotate the conduit or cable which would damage or destroy the electrical wire leads in the conduit or cable.

12 Claims, 7 Drawing Figures

FIG. 1
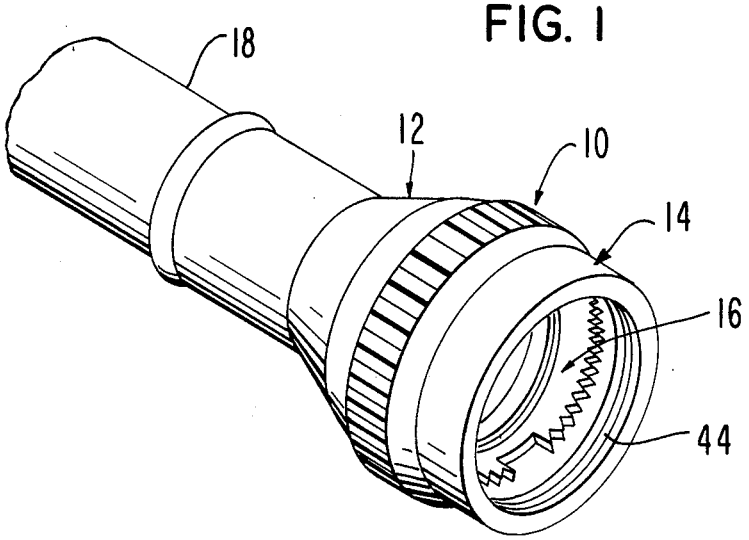
FIG. 2
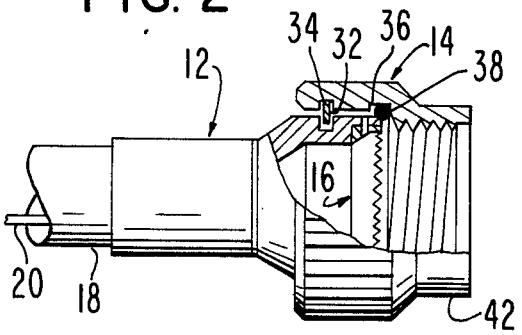
FIG. 3
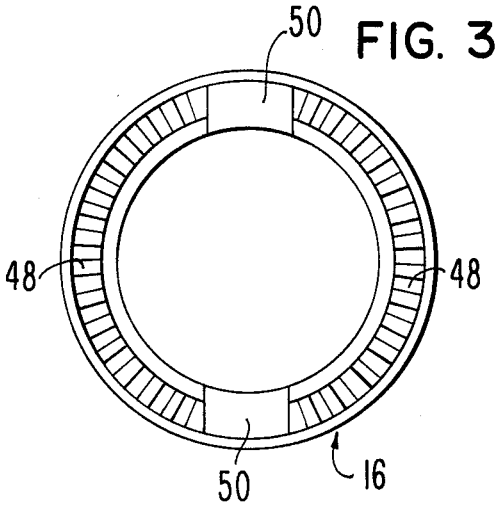
FIG. 5
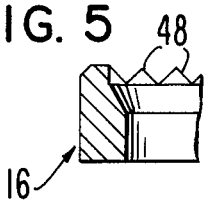
FIG. 4
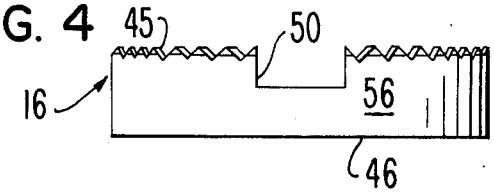
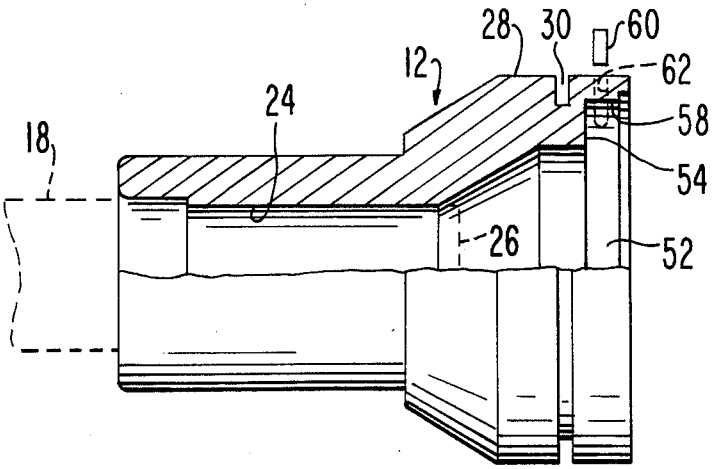
FIG. 6

CONNECTOR/ADAPTER ASSEMBLY FOR FLEXIBLE CONDUIT OR ELECTRICAL CABLE

This invention relates to improvements in connectors for flexible electrical cables and, more particularly, to an improved cable connector/adapter assembly having means to properly mate a pair of misaligned connectors associated with one or more electrical cables or fixed panel-mounted receptacles.

BACKGROUND OF THE INVENTION

Clocking keys or teeth are usually required to couple a first connector attached to one end of a multi-lead electrical cable or conduit to a second connector which is panel-mounted or coupled to another electrical cable. Unless the clocking means of the two connectors is precisely aligned, the connectors cannot be coupled together. The reason for this is that it is impossible generally to twist the cable of the first connector to allow for mating of the two connectors because the rigidity of the cable prevents it from being twisted. Moreover, any attempt to twist the cable could damage or destroy the wire leads or conductors of the cable.

This problem can be and usually is resolved by disassembling the first connector from the cable and then assembling the connector and cable once again to achieve proper clocking of the first and second connectors. This may require that the disassembly and reassembly be done several times since it is a trial and error process requiring a considerable amount of time and expense.

In view of these drawbacks with conventional cable connectors, a need exists for improvements in a cable connector assembly which eliminates the above problem. The present invention satisfies this need.

SUMMARY OF THE INVENTION

The present invention is directed to a connector-/adapter assembly for attachment to one end of a conduit or an electrical cable wherein the assembly includes an adapter provided with a tubular base part or body having a sleeve for receiving the cable, the body being rotatably coupled to an end part or nut having internal threads for attachment to a connector, whereby the adapter and the connector form the assembly of the present invention. Such assembly can be releasably coupled to a second connector which may be panel-mounted or coupled to a second electrical cable.

The adapter of the present invention has a clocking means shiftably mounted in the open end of the adapter body, the clocking means being prevented from axial movement away from the body part. Preferably, the clocking means comprises a rotatable ring. Means extending into a circumferentially extending recess of the clocking ring limits its rotational movement to a predetermined arc, such as an arc of 30°, 15° on either side of an equilibrium position with reference to the adapter body.

The clocking means has teeth or keys which mate with corresponding teeth on the adjacent connector of the assembly. Since the clocking means can shift at least through a limited distance relative to the body, the clocking means allows the mating of the connector with a second connector of the assembly when the clocking means of the two connectors are precisely aligned. Thus, coupling of the two connectors together can be achieved without having to rotate the adapter or to attempt to twist the cable to which the adapter is coupled.

The primary object of the present invention is to provide an improved connector/adapter assembly for a flexible conduit or electrical cable wherein the assembly has a shiftable clocking means to compensate for clocking misalignment between the connector of the assembly and a second connector to thereby permit the connectors to be readily coupled together when they would otherwise be prevented from being mated because of the misalignment yet not allow sufficient axial rotation to cause damage to internal circuits.

Other objects of this invention will become apparent as the following specification progresses, reference being had to the accompanying drawings for an illustration of the invention.

IN THE DRAWINGS

FIG. 1 is a perspective view of the adapter of the connector/adapter of the present invention;

FIG. 2 is a side elevational view, partly broken away and in section, of the adapter of FIG. 1, showing the clocking ring in the device;

FIG. 3 is an enlarged, front elevational view of the clocking ring of the present invention;

FIG. 4 is a side elevational view of the clocking ring;

FIG. 5 is a fragmentary, cross-sectional view of the clocking ring;

FIG. 6 is a side elevational view, partly broken away and in section, of the tubular body of the adapter of this invention.

Figure 7:
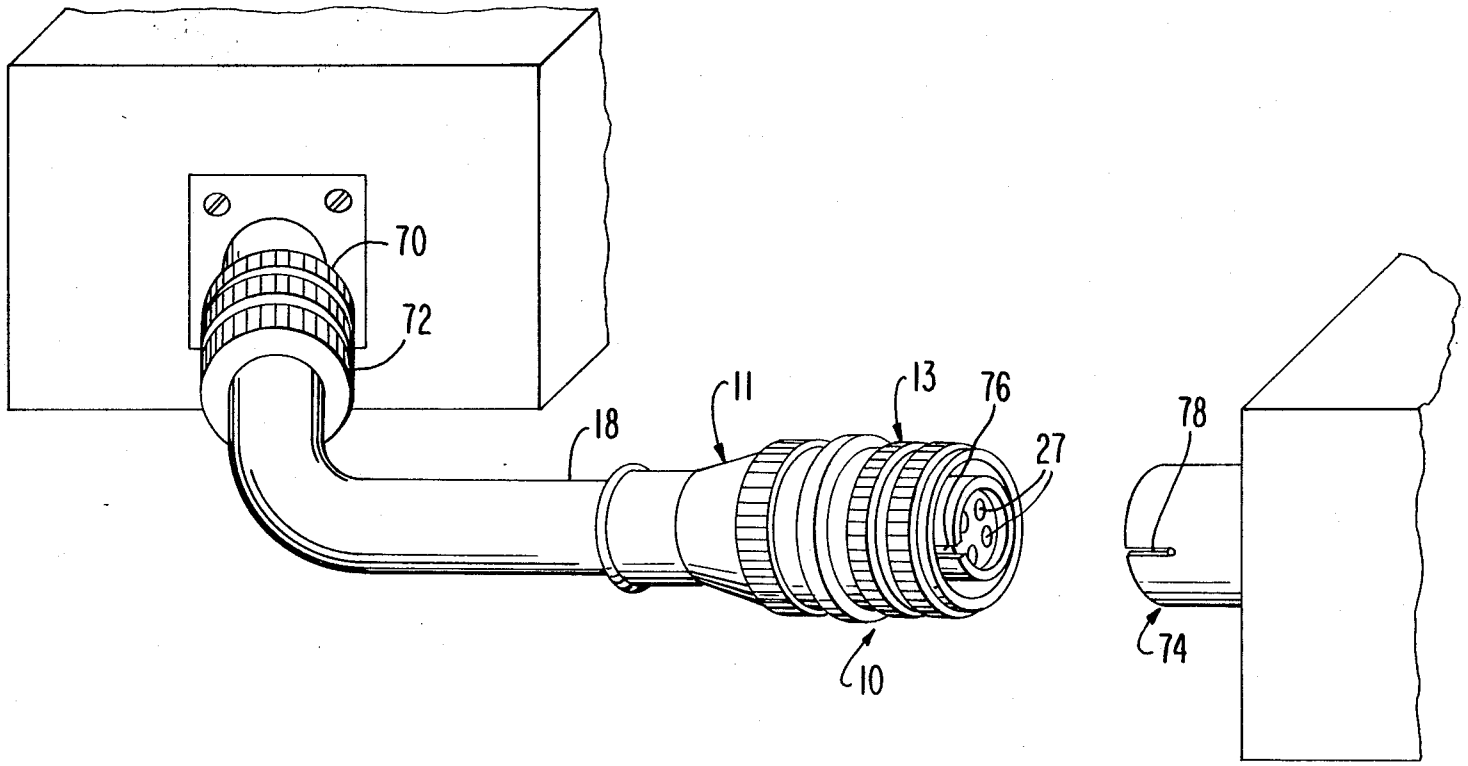
FIG. 7 is a perspective view of the connector-/adapter assembly of the present invention, showing the way it can be coupled to a panel-mounted connector.

The connector/adapter assembly of the present invention is broadly denoted by the numeral 10 and is shown in FIG. 7. It comprises an adapter 11 and a connector 13, the connector being any one of a number of conventional designs.

Adapter 11 includes a tubular body 12, an internally threaded, rotatable nut 14 mounted on one end of the body 12, and a clocking ring 16 rotatably mounted in body 12 near nut 14. The ring 16 is restrained against rotation beyond a limit, such as 15° in either direction on either side of an equilibrium position relative to body 12.

Body 12 is adapted to be coupled, such as by a press fit, to a cable 18 having one or more wire leads 20 extending therethrough. The cable 18 will extend into the internal bore 24 (FIG. 6) of the end part 12, and the cable will terminate near a region denoted by the numeral 26 (FIG. 6) from which region the wire leads 20 thereof will extend to the adjacent inner end of a grommet 25 carried within connector 13 and provided with holes 27 for mounting the ends of respective wire leads 20 when the adapter 11 and connector 13 are coupled together as hereinafter described.

Body 12 has a generally cylindrical outer surface 28 at the end thereof near nut 14. An annular groove 30 is formed in surface 28 and extends radially inwardly therefrom. Groove 30 is adapted to receive a retaining ring 32 which is also received within a corresponding groove 34 in the adjacent cylindrical inner surface of nut 14 as shown in FIG. 2. In this way, nut 14 is coupled to body 12 but is rotatable without limit in either direction.

Nut 14 has a second, internal groove 36 between the ends thereof for receiving a resilient, annular seal 38, such as an O-ring. Seal 38 is adapted to engage the adjacent end face 40 of body 12 (FIG. 6) so as to form a fluid-tight junction between nut 14 and end face 40 when the nut tightly couples adapter 11 and connector 13 together.

Nut 14 is further provided with a cylindrical sleeve 42 provided with internal threads 44. Thus, nut 14 can be threaded onto the threaded end 45 of connector 13. In this way, the adapter 11 is coupled to connector 13 to complete assembly 10.

Clocking ring 16 has a configuration of the type shown in FIGS. 3–5. Ring 16 has a generally cylindrical body having a flat, annular end face 46 and a plurality of teeth 48 at the opposite end thereof, the teeth being sawtooth in configuration and being provided to mate with similar teeth or keys (not shown) on threaded end 45 of connector 13. Ring 16 has a pair of generally rectangular, diametrically opposed recesses 50 (FIGS. 3 and 4), each recess extending axially from the end of the ring having teeth 48 to a location substantially mid-way between end face 46 and teeth 48 shown in FIG. 4.

Ring 16 is mounted within an annular region 52 (FIG. 6) of body 12. When so mounted, ring 16 has its flat end face 46 in sliding engagement with the annular, flat face 54 (FIG. 6) of body 12, cylindrical outer surface 56 (FIG. 4) of ring 16 being contiguous to the annular, inner surface 58 (FIG. 6) of body 12. When the ring is so mounted, teeth 48 will generally be in the plane of flat end face 40 of body 12.

A projection is provided for each recess 50, respectively, to restrain the ring 16 against axial movement relative to body 12 and to limit the rotation of the ring to a predetermined arc, such as an angle in the range of 15° to 30°. Such projection can be a coined dimple on the inner surface 58 of body 12 or can be a pin. For purposes of illustration, a pin 60 will be described as being the projection.

Each pin 60 is received within a radial bore 62 and the pin normally extends into the respective recess 50 as shown in FIG. 1. When the pin is inserted in its bore 62, the outer end of the pin is flush with the outer surface 28 of body 12.

In use, adapter assembly 10 has clocking ring 16 in the operative position thereof shown in FIGS. 1 and 2, and nut 14 is threadably coupled to connector 13. Cable 18 will have been coupled to assembly 10 and is adapted to be electrically coupled, for example, to a panel-mounted connector 70 by means of a connector 72 on the opposite end of cable 18. Connector 13 of assembly 10 is, for purposes of illustration, adapted to be coupled to another panel-mounted connector 74 (FIG. 7).

When the connector 13 of assembly 10 is brought into proximity to connector 74, connector 13 must be in proper clocking relationship to connector 74. To establish this relationship, a slot 76 in connector 13 must be aligned with a key 78 on connector 74 before connectors 13 and 74 can be coupled together. If the slot and key are so aligned, the connectors are brought together and are joined in a conventional manner.

If slot 76 is circumferentially offset from or misaligned relative to key 78 when connector 13 is brought into proximity to connector 74, then connector 13 is manually rotated relative to adapter 11 until the slot and key are aligned, whereupon the connectors are then coupled together in the conventional manner.

The misalignment of the slot and key can be compensated for because ring 16 is rotatable relative to adapter 11 even though nut 14 tightly couples connector 13 to body 12. Since ring 16 is coupled to connector 13, manual rotation of connector 13 allows rotation of ring 16 and thereby permits the slot and key to become aligned without having to twist cable 18 or without having to disassemble assembly 10 and put it back onto the end of the cable in a new clocked position.

I claim:

1. A connector/adapter assembly for coupling one end of a conduit or electrical cable to a first connector having a first clocking means comprising:

a tubular adapter having a pair of opposed, open ends, one end of the adapter being adapted to receive one end of a conduit or electrical cable;

a second connector having second clocking means and adapted to be coupled to the first connector when the second clocking means is aligned with the first clocking means;

means coupled with the adapter for releasably attaching the second connector in an operative position on the adapter;

a ring rotatably mounted on said adapter; and means carried by the adapter and coupled to the ring for limiting the rotational movement of the ring relative to the adapter, said ring permitting the second connector to move relative to the adapter when the second connector is in said operative position, whereby the second connector can be shifted relative to the first connector to compensate for misalignment between said second clocking means and said first clocking means.

2. An assembly as set forth in claim 1, wherein the adapter has a central axis, said ring being rotatable about said central axis.

3. An assembly as set forth in claim 1, wherein said limiting means includes a pin carried by the adapter, said ring having a recess therein, said pin extending into the recess.

4. An assembly as set forth in claim 3, wherein said pin extends radially of the central axis of the adapter.

5. An assembly as set forth in claim 1, wherein said adapter has a radial projection defining said limiting means.

6. An assembly as set forth in claim 1, wherein the ring is rotatable through an angle in the range of 15° to 30°.

7. In a connector/adapter assembly for coupling a first connector having a first clocking means to a second electrical connector having second clocking means comprising:

a tubular adapter having a pair of opposed, open ends, one end of the adapter being adapted to receive one end of a conduit or electrical cable, said adapter having an open end for at least partially receiving said first connector, the latter adapted to be coupled to the second connector when the second clocking means is aligned with the first clocking means;

means coupled with the adapter for releasably attaching the first connector in an operative position on the adapter;

a ring rotatable mounted on said adapter; and means carried by the adapter and coupled to the ring for limiting the rotational movement of the ring relative to the adapter, said ring permitting the first connector to move relative to the adapter when the first connector is in said operative position, whereby the first connector can be shifted relative to the second connector to compensate for misalignment between said first clocking means and said second clocking means.

8. In an assembly as set forth in claim 7, wherein the adapter has a central axis, said ring being rotatable about said central axis.

9. In an assembly as set forth in claim 7, wherein said limiting means includes a pin carried by the adapter, said ring having a recess therein, said pin extending into the recess.

10. In an assembly as set forth in claim 9, wherein said pin extends radially of the central axis of the adapter.

11. In an assembly as set forth in claim 7, wherein said adapter has a radial projection defining said limiting means.

12. In an assembly as set forth in claim 7, wherein the ring is rotatable through an angle in the range of 15° to 30°.

* * * * *